US008793913B1

(12) United States Patent
Zobel et al.

(10) Patent No.: US 8,793,913 B1
(45) Date of Patent: Aug. 5, 2014

(54) SHELF LABEL HOLDER

(71) Applicant: Target Brands, Inc., Minneapolis, MN (US)

(72) Inventors: Erin L. Zobel, Minneapolis, MN (US); Timothy J. Martell, Brooklyn Park, MN (US); Jennifer A. Theisen, Crystal, MN (US); William Y. Stafford, Minnetrista, MN (US)

(73) Assignee: Target Brands, Inc., Minneapolis, MN (US)

( * ) Notice: Subject to any disclaimer, the term of this patent is extended or adjusted under 35 U.S.C. 154(b) by 0 days.

(21) Appl. No.: 13/893,636

(22) Filed: May 14, 2013

(51) Int. Cl.
*G09F 3/18* (2006.01)

(52) U.S. Cl.
CPC ..... *G09F 3/18* (2013.01)
USPC ..... 40/661.03; D20/43; D20/44

(58) Field of Classification Search
CPC ..... G09G 3/18
USPC ..... 40/661.03, 661, 654.01; D20/43, 44
See application file for complete search history.

(56) References Cited

U.S. PATENT DOCUMENTS

| | | | | |
|---|---|---|---|---|
| 2,827,718 | A | | 3/1958 | Howard |
| 2,830,394 | A | | 4/1958 | Gordon et al. |
| 3,084,463 | A | | 4/1963 | Guyer et al. |
| 3,159,937 | A | | 12/1964 | Barnes |
| 4,557,064 | A | | 12/1985 | Thompson |
| 4,606,141 | A | | 8/1986 | Murray |
| 4,694,600 | A | | 9/1987 | Murray |
| D325,401 | S | * | 4/1992 | Garfinkle ..... D20/43 |
| 5,220,739 | A | | 6/1993 | Chich et al. |
| 5,419,066 | A | | 5/1995 | Harnois et al. |
| 5,577,337 | A | * | 11/1996 | Lin ..... 40/642.02 |
| 6,105,295 | A | | 8/2000 | Brinkman et al. |
| 6,145,232 | A | | 11/2000 | Bevins |
| D454,163 | S | * | 3/2002 | Nagel ..... D20/43 |
| 6,470,613 | B1 | | 10/2002 | Wildrick |
| D479,278 | S | * | 9/2003 | Nagel ..... D20/43 |

(Continued)

FOREIGN PATENT DOCUMENTS

| | | | |
|---|---|---|---|
| DE | 202011107543 U1 | * | 4/2012 |
| FR | 2907955 A1 | * | 5/2008 |

OTHER PUBLICATIONS

Office Action from Canadian Patent Application No. 2,820,349, mailed Oct. 9, 2013 (2 pages).

(Continued)

*Primary Examiner* — Casandra Davis
(74) *Attorney, Agent, or Firm* — Leanne Taveggia Farrell; Westman, Champlin & Koehler, P.A.

(57) ABSTRACT

A label holder includes a main panel having a top portion that is oriented at an angle from a substantially planar portion, a first sign sleeve and a second sign sleeve. The first sign sleeve is defined by the substantially planar portion of the main panel and a return flange coupled to the main panel at a joined end. The return flange extends upward from the joined end and terminates along and is biased against the substantially planar portion of the main panel. The second sign sleeve is defined by a front that extends from the top portion of the main panel and a back that is coupled to the front by the top portion of the main panel. The back extends from the top portion of the main panel and terminates along and is biased against the front.

18 Claims, 5 Drawing Sheets

(56) References Cited

U.S. PATENT DOCUMENTS

| | | | | |
|---|---|---|---|---|
| 6,622,410 | B2 | 9/2003 | Wilkes et al. | |
| 6,823,620 | B2 | 11/2004 | Nagel | |
| 6,935,060 | B2 | 8/2005 | Bjerke et al. | |
| 6,935,061 | B2 | 8/2005 | Thompson | |
| 7,316,089 | B2 | 1/2008 | Brinkman | |
| 7,340,855 | B2 | 3/2008 | Wiltfang et al. | |
| D569,916 | S * | 5/2008 | Garfinkle | D20/43 |
| D580,992 | S * | 11/2008 | Garfinkle | D20/43 |
| 7,574,822 | B1 | 8/2009 | Moore | |
| 7,578,088 | B2 | 8/2009 | Alves | |
| D614,241 | S * | 4/2010 | Garfinkle et al. | D20/44 |
| 7,836,621 | B2 | 11/2010 | Mueller et al. | |
| 8,011,126 | B2 | 9/2011 | Nunez et al. | |
| 8,172,096 | B2 | 5/2012 | Van De Steen | |
| D673,223 | S * | 12/2012 | White | D20/43 |
| 2004/0237369 | A1 | 12/2004 | Andersson | |
| 2006/0053670 | A1 * | 3/2006 | Wiltfang et al. | 40/661.03 |
| 2007/0245611 | A1 | 10/2007 | McDonald | |
| 2008/0295373 | A1 * | 12/2008 | Garfinkle | 40/606.19 |

OTHER PUBLICATIONS

Office Action from Canadian Patent Application No. 2,820,349, mailed Jan. 16, 2014 (3 pages).

* cited by examiner

SHELF LABEL HOLDER

BACKGROUND

Businesses use a variety of types of display structures to present products and related information to customers for purchase. These display structures support both the product and shelf-type price label holders that receive printed material indicating the product price. An example display structure includes shelf-type structures having shelf-type price label holders.

The discussion above is merely provided for general background information and is not intended to be used as an aid in determining the scope of the claimed subject matter.

SUMMARY

A shelf assembly includes a first shelf label holder coupled to a shelf-type display structure and a second shelf label holder coupled to the first shelf label holder. The first shelf label holder has a main panel coupled to a flap at a joined bottom end. The flap is biased against the main panel. The second shelf label holder has a first pocket including a main panel coupled to a flap at a joined bottom end and a first support. The flap of the second shelf label holder is biased against a front of the main panel of the second shelf label holder and the first support is coupled to a back surface of the main panel of the second shelf label holder. The first support of the second shelf label holder is inserted between the main panel and the flap of the first shelf label holder.

The main panel of the second shelf label holder has a top portion that is oriented at an angle from a substantially planar portion and includes the first pocket or first sign sleeve and a second pocket or second sign sleeve. The first pocket or first sign sleeve is defined by the substantially planar portion of the main panel and the flap coupled to the main panel at the joined end. The flap extends upward from the joined end and terminates along and is biased against the substantially planar portion of the main panel. The second pocket or second sign sleeve is defined by a front that extends from the top portion of the main panel and a back that is coupled to the front by the top portion of the main panel. The back extends from the top portion of the main panel and terminates along and is biased against the front.

This Summary is provided to introduce a selection of concepts in a simplified form that are further described below in the Detailed Description. This Summary is not intended to identify key features or essential features of the claimed subject matter, nor is it intended to be used as an aid in determining the scope of the claimed subject matter. The claimed subject matter is not limited to implementations that solve any or all disadvantages noted in the background.

DETAILED DESCRIPTION

In a business, such as a retail store, different types of shelf-type display structures are used to display different products. For example, small, light-weight products, such as cosmetics, may use a first type of display structure to present the light-weight products for purchase, while heavier products, such as shampoo, may use a second type of shelf-type display structure to present heavier-weight products for purchase. In some circumstances, different shelf-type display structures have different shelf label holders attached at their ends. As a result, when different shelf-type display structures are used in a common area, the shelf-type display structures have a non-uniform appearance because their label holders are different.

As will be described in detail below, a shelf label holder is engaged with an existing shelf label holder in an area of a business where different types of shelf-type display structures are needed. The engagement of the shelf label holder with the existing shelf label holder modifies or alters the existing shelf label holder so that the appearance of the shelf-type display structure is more uniform with other shelf-type display structures in the area. The shelf label holder includes a first pocket for receiving a printed medium and a second pocket for receiving printed price labels. The first pocket extends along a front end of a shelf, while the second pocket is located on top of the shelf or above the shelf.

Figure 1:
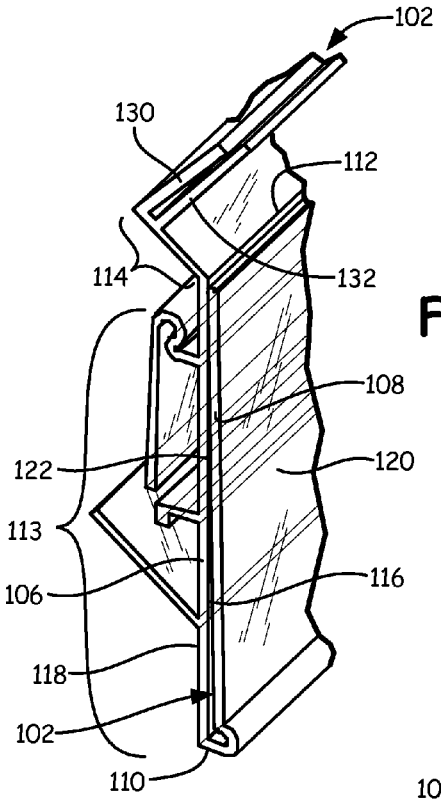
FIG. 1 is a perspective view of a portion of a shelf label holder according to one embodiment.

FIG. 1 is a perspective view of an end portion of a shelf label holder 100 according to one embodiment. A front view, a back view, a left side view (a right side view being a mirror image), a top view and a bottom view of the end portion are illustrated in FIGS. 2-6. In one embodiment, shelf label holder 100 is integrally formed, such as by extruding a polymer or plastic, and includes a first sign sleeve or pocket 102 for receiving printed medium and a second sign sleeve or pocket 104 for receiving at least one printed price label.

Figure 4:
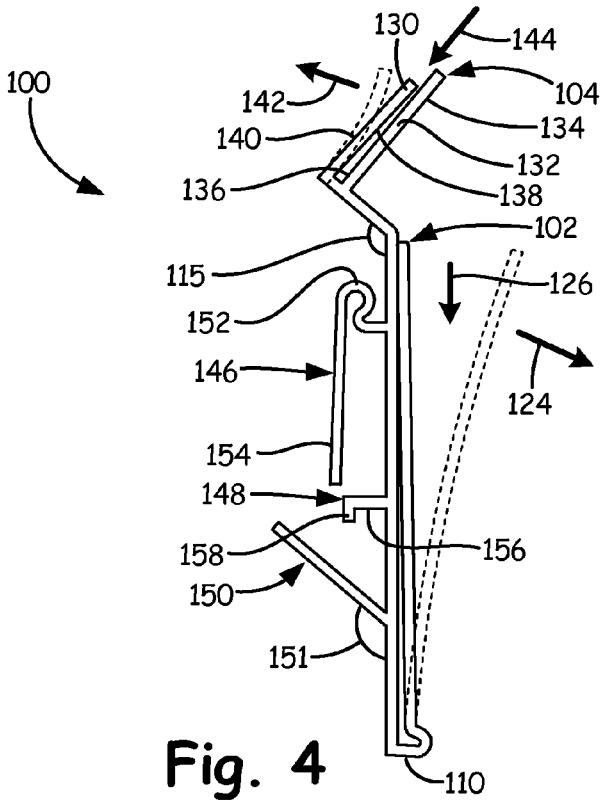
FIG. 4 is a side view of the portion of the shelf label holder illustrated in FIG. 1.
Figure 5:
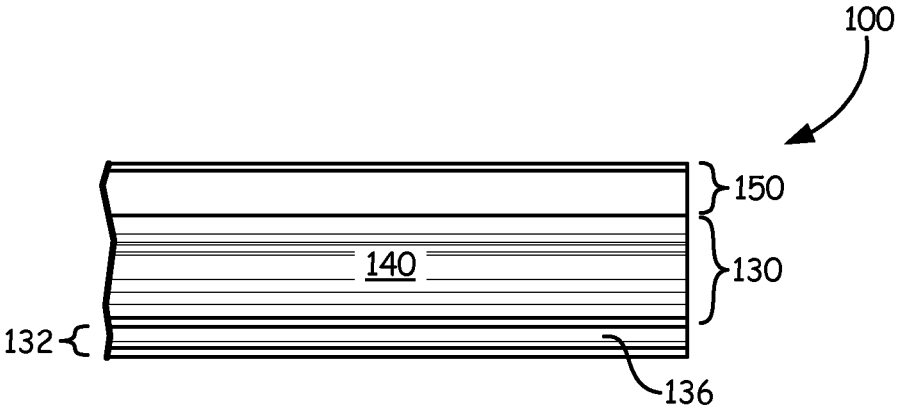
FIG. 5 is a top view of the portion of the shelf label holder illustrated in FIG. 1.
Figure 6:
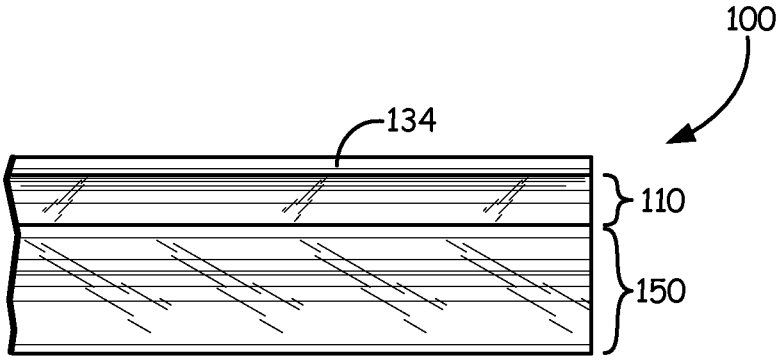
FIG. 6 is a bottom view of the portion of the shelf label holder illustrated in FIG. 1.

First sign sleeve 102 is defined by a main panel 106 and a return flange or flap 108 that is coupled to main panel 106 at a joined end 110. At least return flange or flap 108 is made of a transparent polymer or plastic such that the printed medium that is received by first sign sleeve 102 can be clearly viewed. In another embodiment, however, both main panel 106 and return flange 108 are made of a transparent polymer or plastic. Except for a top portion 114, main panel 106 extends substantially planar as illustrated in FIG. 4 along a substantially planar portion 113. Main panel 106 includes a bend 112 such that top portion 114 of main panel 106 is oriented at an angle 115 from a substantially planar portion 113 of main panel 106. For example, top portion 114 can be oriented from substantially planar portion 113 at an angle 115 that is substantially equal to about 130 degrees. Main panel 106 includes a front surface 116 and a back surface 118 opposite front surface 116 and return flange 108 includes a front surface 120 and a back surface 122 opposite front surface 120.

Figure 2:
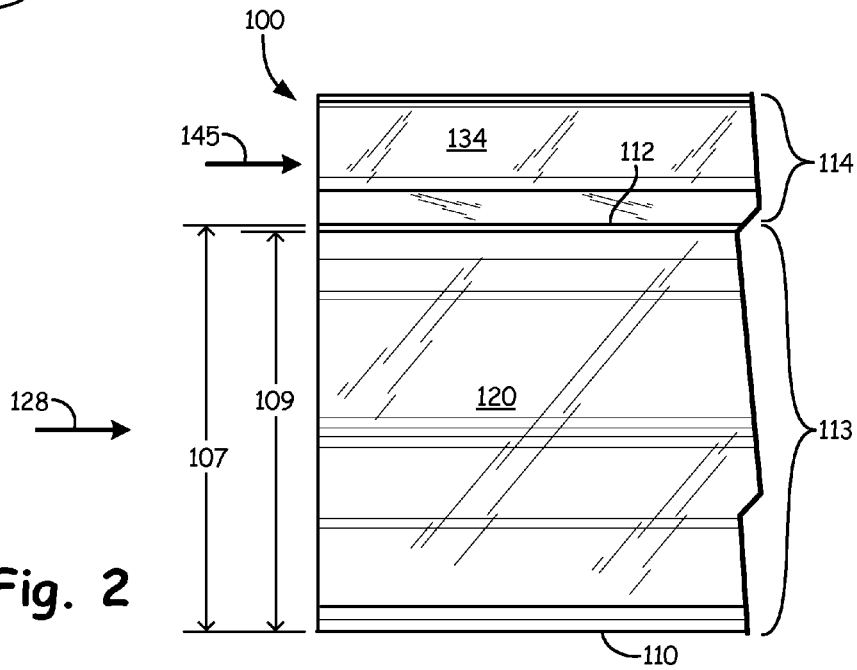
FIG. 2 is a front view of the portion of the shelf label holder illustrated in FIG. 1.
Figure 3:
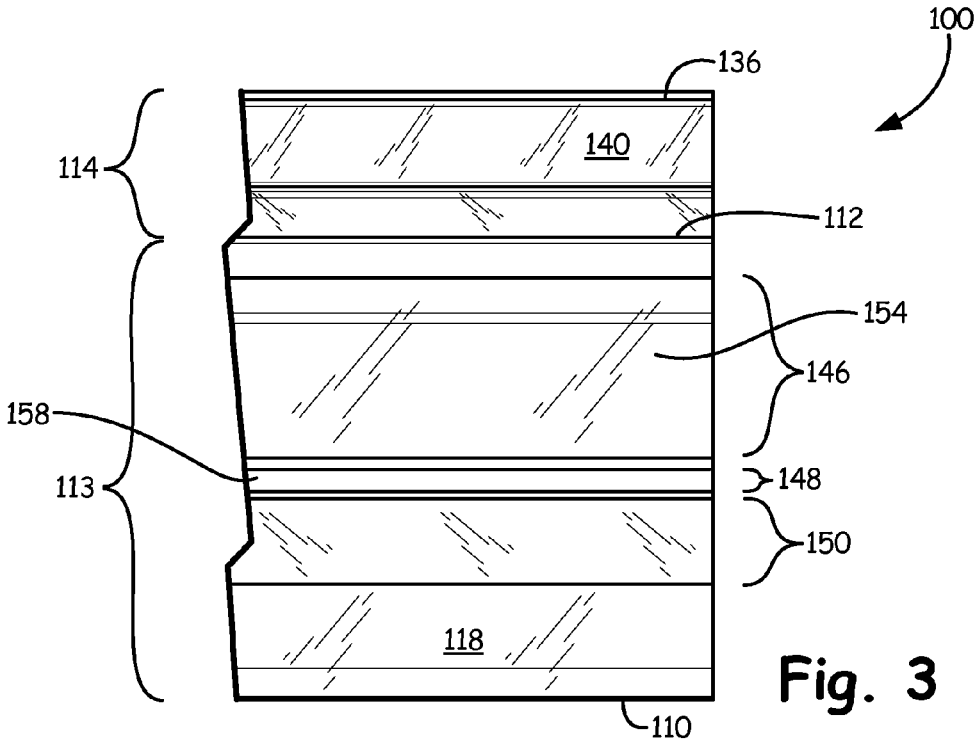
FIG. 3 is a back view of the portion of the shelf label holder illustrated in FIG. 1.

Return flange 108 extends from joined end 110 in a generally up-turned or upward manner and terminates along main panel 106 at a height 109 (FIG. 2) that is less than a height 107 (FIG. 2) of the substantially planar portion 113 of main panel 106. In one embodiment, return flange 108 is substantially flexible and is biased towards the substantially planar portion 113 of main panel 106. More specifically, return flange 108 is biased such that back surface 122 of return flange 108 is biased to interact with or contact a portion of front surface 116 of main panel 106. The flexible nature of return flange 108 allows return flange 108 to be rotated about joined end 110 as indicated by arrow 124 (FIG. 4). Rotation of return flange 108 allows a printed medium to be placed between return flange 108 and main panel 106 and into first sign sleeve or pocket 102 in a top-down manner as indicated by arrow 126 (FIG. 4). In an alternative embodiment, a printed medium can be placed between return flange 108 and main panel 106 from a side of shelf label holder 100 as indicated by arrow 128 (FIG. 2). In one embodiment, the printed medium placed in first sign sleeve 102 can be thin gauge printable sheet material, such as paper, cardstock, paper board, etc., that is printed with textual and/or graphical indicia including generalized information relating to a number of particular items being displayed on the shelf to which shelf label holder 100 is attached, such as indicia indicative of brand identification, graphical designs and the like.

Second sign sleeve 104 is defined by a back 130 and a front 132 that is coupled to back 130 by top portion 114 of main panel 106. At least front 132 is made of a transparent polymer or plastic such that the price label(s) that are received by second sign sleeve 104 can be clearly viewed. In another embodiment, both front 132 and back 130 are made of a transparent polymer or plastic. Front 132 of second sign sleeve 104 extends substantially perpendicular to top portion 114 of main panel 106 and includes a front surface 134 and a back surface 136. Back 130 of second sign sleeve 104 includes a front surface 138 and a back surface 140.

In one embodiment, back 130 is substantially flexible and is biased towards front 132. More specifically, back 130 is biased such that front surface 138 of back 130 is biased to interact with or contact a portion of back surface 136 of front 132. The flexible nature of back 130 allows back 130 to be rotated about top portion 114 of main panel 106 as indicated by arrow 142 (FIG. 4). Rotation of back 130 allows the price label(s) to be placed between back 130 and front 132 and into second sign sleeve 104 in a top-down manner as indicated by arrow 144 (FIG. 4). In an alternative embodiment, a printed medium can be placed between back 130 and front 132 from a side of shelf label holder 100 as indicated by arrow 145 (FIG. 2). In one embodiment, the price label(s) can be a thin gauge printed sheet material, such as paper, cardstock, paper board, etc., printed with textual and/or graphical indicia including information relating to a number of particular items being display on the shelf to which shelf label holder 100 is attached. In particular, indicia printed on the price label(s) can indicate product type, department, sale status, supply availability, item price, item name and a bar code or other scannable portion that can be scanned through front 132 and being related to the goods displayed on the shelf behind each price label.

In one embodiment, a plurality of supports 146, 148 and 150 are coupled to back surface 118 of main panel 106 and are configured to engage with another shelf label holder that is already engaged with a channel on a shelf-type display structure or that is to be engaged with a channel on a shelf-type display structure. First support 146 extends from back surface 118 of main panel 106 and defines a hook or down-turned member 152 that orients a downward portion 154 of first support 146 so that it is substantially parallel with substantially planar portion 113 of main panel 106. Second support 148 is located below first support 146 and includes a main portion 156 that protrudes substantially perpendicular to the substantially planar portion 113 of main panel 106 that return flange 108 is biased against. Second support 148 includes an end portion 158 oriented downwards that is substantially perpendicular to main portion 156 of second support 148 and substantially parallel with the substantially planar portion 113 of main panel 106. Third support 150 is located below second support 148 and protrudes from back surface 118 of substantially planar portion 113 of main panel 106 at an angle 151 that is oriented upwards. For example and in one embodiment, angle 151 can be substantially equal to angle 115 at which top portion 114 of main panel 106 is oriented from the substantially planar portion 113 of main panel 106. In such an embodiment, angle 151 is substantially equal to about 130 degrees. The function of supports 146, 148 and 150 will be discussed in detail below with reference to FIGS. 7 and 8.

In some areas of a business, different types of shelf-type display structures are needed to present similar yet different products. In some instances the product that needs to be displayed is heavy and requires a more robust shelving system for support than other products being displayed in the same area. For example, beauty products, such as make up and the like, can be displayed on shelves that need not be as robust as shelves displaying heavy bottles of shampoo and conditioner. However, both kinds of products are defined as beauty products and may be displayed in the same area of a business.

Although different shelving systems might be used in the same area of a business, how price labels are presented to the customer on the different shelving systems in the same area of a business should be uniform. Shelf label holder 100 is a component that can be used with a more robust shelving system to present price labels in a manner that is uniform with how price labels are presented on other shelving systems in the same area.

Figure 7:
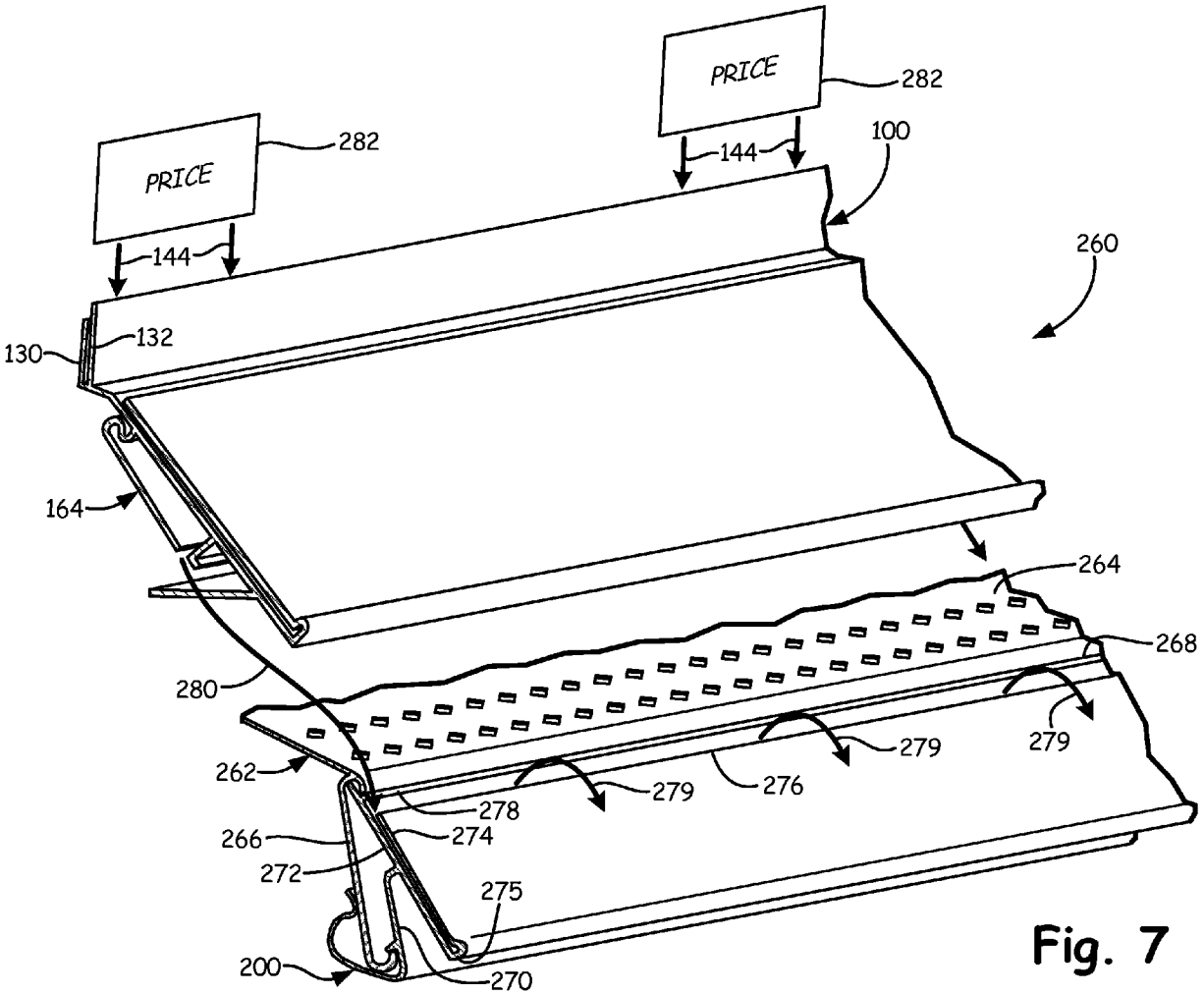
FIG. 7 is an exploded perspective view of a shelf assembly including the section of the shelf label holder illustrated in FIGS. 1-6, a shelf-type display structure and an existing shelf label holder according to one embodiment.
Figure 8:
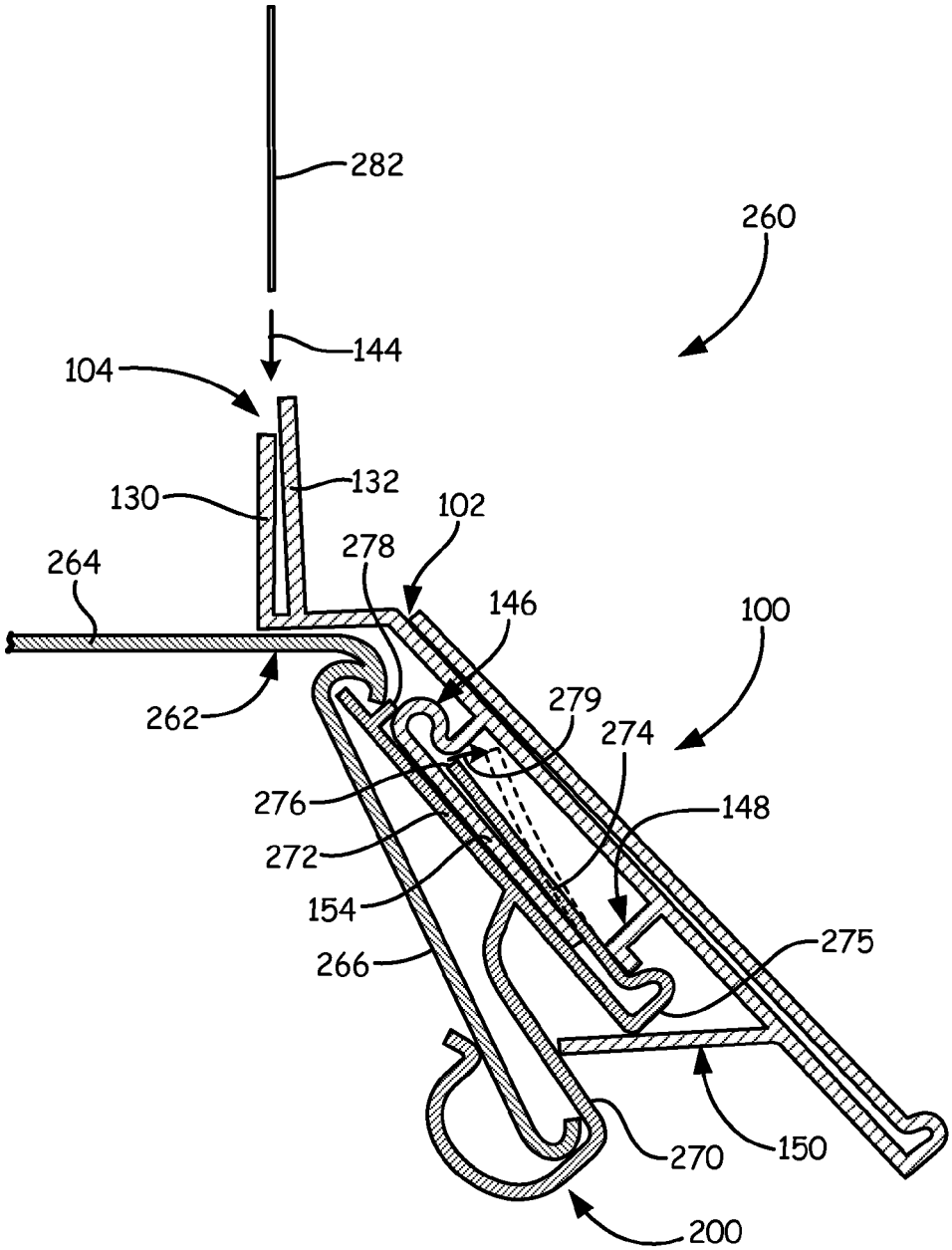
FIG. 8 is an assembled section view of the shelf assembly illustrated in FIG. 7.

FIG. 7 is an exploded perspective view of a shelf assembly 260 including a more extensive section of the shelf label holder 100 illustrated in FIGS. 1-6, a shelf-type display structure 262 and an existing shelf label holder 200. FIG. 8 is section view of shelf assembly 260 including shelf label holder 100 illustrated in FIGS. 1-6 as assembled to existing shelf label holder 200, which is coupled to shelf-type display structure 262 according to one embodiment. Shelf-type display structure 262 is configured to hold and support a plurality of goods or products (not illustrated) that are being offered for sale. Shelf-type display structure 262 includes a shelf 264 and a price holder support structure or open channel 266 coupled to shelf 264 at a bull nose 268. Open channel 266 is substantially C-shaped, extends along shelf 264 and is oriented at an angle from shelf 264. Open channel 266 is configured to retain existing shelf label holder 200. Existing shelf label holder or first shelf label holder 200 is an integrally formed component configured to retain printed material on the front of a shelf that corresponds with goods being supported by shelf 264. For example, printed material can include a price label strip having a plurality of price labels.

Existing shelf label holder 200 can be formed of a polymer, such as a transparent plastic, and includes a support 270 configured to engage with open channel 266. Existing shelf label holder 200 also includes a main panel 272 coupled to a return flange or flap 274 at a joined bottom end 275. It should be realized, main panel 272 and return flange 274 are coupled together at joined bottom end 275 only and not at top ends. Return flange 274 includes a top edge 276. Near top edge 276 of return flange 274, a back surface of the return flange interacts with a front surface of main panel 272. More specifically, return flange 274 is biased toward the front surface of main panel 272. Return flange 274 is flexible relative to main panel 272 in order to allow rotation of return flange 274 about joined bottom end 275 as illustrated by arrow 279 and the phantom lines illustrated in FIG. 8. Main panel 272 includes an extension 278 located in proximity to the top of main panel 272. Extension 278 protrudes from main panel 272 towards top edge 276 of return flange 274 and is located just below or in contact with bull nose 268 of shelf-type display structure 262.

Normally, flexible return flange 274 is rotated about joined bottom end 275 in direction 279 to allow printed material to be inserted between main panel 272 and return flange 274 of existing shelf label holder 200 from the side or from top-down and extension 278 or bull nose 268 secures the printed material in place. However, in the embodiment illustrated in FIGS. 7 and 8, flexible return flange 274 is rotated about joined bottom end 275 in direction 279 to allow downward portion 154 of first support 146 of shelf label holder or second shelf label holder 100 to be inserted between main panel 272 and return flange 274 of existing shelf label holder or first shelf label holder 200 in a top-down direction as illustrated by arrow 280 (FIG. 7). In this way, second shelf label holder 100 modifies how first shelf label holder 200 normally presents printed material to the customer when shelf-type display structure 262 is used in the same area of a business that includes other shelf-type display structures.

Upon downward portion 154 of first support 146 being inserted between main panel 272 and return flange 274 of existing shelf label holder 200, shelf label holder 100 can also engage with existing shelf label holder 200 using second support 148 and third support 150. In particular, end portion 158 of second support 148 can engage with a front surface of return flange 274 to aid in maintaining downward portion 154 between main panel 272 and return flange 274. In addition, an end of third support 150 can engage with a surface of support 270 of existing shelf label holder 200 to additionally aid in maintaining downward portion 154 between main panel 272 and return flange 274.

As illustrated in FIG. 8, first pocket or first sign sleeve 102 of second shelf label holder 100 is located in such a position as to be located at a front of shelf 264 and therefore located in front of the first shelf label holder 200. Second pocket or second sign sleeve 104 of second shelf label holder on the other hand is located in such a position that it appears to be located on top of or above shelf 264.

As previously described, a printed medium can be placed in or inserted into first sign sleeve 102 of second shelf label holder 100. Upon first sign sleeve 102 receiving a printed medium, not only will existing shelf label holder 200 be hidden from view, but any printed material that may be inserted between main panel 272 and return flange 274 on existing shelf label holder 200 will also be hidden from view. Printed price labels, such as printed price labels 282 (FIGS. 7 and 8), can be inserted between back 130 and front 132 of second sign sleeve 104 in a top-down manner as indicated by arrows 144. In this way, not only are price labels located in shelf label holder 100 presented to customers in the same way as other shelf-type display structures in the same area of the business, but since second sign sleeve 104 appears to be located on top of or above shelf 264, products being displayed directly behind each price label on shelf 264 correspond with the price label presented. This set up is much different than the price label being presented on the front of the shelf and causes price labels to be placed nearer products they describe.

Although the subject matter has been described in language specific to structural features and/or methodological acts, it is to be understood that the subject matter defined in the appended claims is not necessarily limited to the specific features or acts described above. Rather, the specific features and acts described above are disclosed as example forms of implementing the claims.

What is claimed is:

1. A label holder comprising:

a main panel having a bend such that a top portion of the main panel is oriented at an angle from a substantially planar portion;

a first sign sleeve for receiving a printed medium and being defined by:

the substantially planar portion of the main panel;

a return flange coupled to the main panel at a joined end and extending upward from the joined end and terminating along the substantially planar portion of the main panel, wherein the return flange is biased against the substantially planar portion of the main panel;

a second sign sleeve for receiving at least one printed price label and being defined by:

a front that extends from the top portion of the main panel by a height; and a back coupled to the front by the top portion of the main panel, wherein the back extends from the top portion of the main panel by a height;

wherein the height of the front is greater than the height of the back and the back is biased against the front.

2. The label holder of claim 1, further comprising a plurality of supports attached to a back surface of the substantially planar portion of the main panel.

3. The label holder of claim 2, wherein the plurality of supports comprises a first support that extends from the back surface of the substantially planar portion of the main panel and defines a hook that orients a downward portion of the first support so that it is substantially parallel with the substantially planar portion of the main panel.

4. The label holder of claim 3, wherein the plurality of supports further comprises a second support located below the first support.

5. The label holder of claim 4, wherein the second support comprises:

a main portion that extends from the back surface of the substantially planar portion of the main panel and is substantially perpendicular to the substantially planar portion of the main panel; and an end portion oriented downwards that is substantially perpendicular to the main portion of the second support and is substantially parallel with the substantially planar portion of the main panel.

6. The label holder of claim 4, wherein the plurality of supports further comprises a third support located below the second support.

7. The label holder of claim 6, wherein the third support extends from a back surface of the substantially planar portion of the main panel at an angle.

8. The label holder of claim 7, wherein the angle at which the third support extends from the back surface of the substantially planar portion of the main panel is substantially equal to the angle at which the top portion of the main panel is oriented from the substantially planar portion of the main panel.

9. A shelf assembly comprising:

a first shelf label holder coupled to a shelf-type display structure and including a main panel coupled to a flap at a joined bottom end, the flap being biased against the main panel; and a second shelf label holder coupled to the first shelf label holder and having a first pocket including a main panel coupled to a flap at a joined bottom end and a first support, the flap of the second shelf holder being biased against a front of the main panel of the second shelf label holder and the first support being coupled to a back surface of the main panel of the second shelf label holder;

wherein the first support of the second shelf label holder is inserted between the main panel and the flap of the first shelf label holder; and wherein the main panel of the second shelf label holder comprises a substantially planar portion and top portion oriented at an obtuse angle from the substantially planar portion.

10. The shelf assembly of claim 9, wherein the first pocket of the second shelf label holder is configured to receive a printed medium.

11. The shelf assembly of claim 9, wherein the second shelf label holder comprises a second pocket including a front coupled to a back by the top portion of the main panel of the second shelf label holder, wherein the front and the back extend from the top portion of the main panel of the second shelf holder.

12. The shelf assembly of claim 11, wherein the back is biased against the front.

13. The shelf assembly of claim 11, wherein the second pocket of the second shelf label holder is configured to receive a printed price label.

14. The shelf assembly of claim 9, wherein the second shelf label holder comprises a second support attached to and extending from the back surface of the main panel of the second shelf label holder, wherein the second support of the second shelf label holder contacts the first shelf label holder.

15. A method of altering a shelf-type display structure, the method comprising:

providing a first shelf label holder coupled to a shelf-type display structure and including a main panel coupled to a flap at a joined bottom end, the flap being biased against the main panel; and inserting a first support extending from a back surface of a main panel of a second shelf label holder between the main panel and the flap of the first shelf label holder, wherein the second shelf label holder comprises:

a first pocket defined by a substantially planar portion of the main panel of the second shelf label holder;

a flap joined to the substantially planar portion of the second shelf label holder by a joined bottom end and being biased against the substantially planar portion;

a top portion of the main panel of the second shelf label holder oriented at an angle from the substantially planar portion of the main panel of the second shelf label holder; and a second pocket including a front coupled to a back by the top portion of the main panel of the second shelf label holder, wherein the front and the back extend from the top portion of the main panel of the second shelf holder.

16. The method of claim 15, further comprising inserting a printed medium in the first pocket of the second shelf label holder.

17. The method of claim 15, wherein the back is biased against the front.

18. The method of claim 15, further comprising inserting a printed price label in the second pocket of the second shelf label holder.

* * * * *